US005099976A

United States Patent [19]

Jamison

[11] Patent Number: 5,099,976

[45] Date of Patent: Mar. 31, 1992

[54] FIRE EXTINGUISHING APPARATUS FOR COMPRESSORS

[75] Inventor: Will B. Jamison, McMurray, Pa.

[73] Assignee: W. B. Jamison Limited Partnership, McMurray, Pa.

[21] Appl. No.: 600,571

[22] Filed: Oct. 19, 1990

[51] Int. Cl.[5] ..... A62C 3/00; A62C 3/06

[52] U.S. Cl. ..... 169/54; 169/45; 169/46; 169/56; 169/DIG. 1; 417/32; 417/310; 418/DIG. 1

[58] Field of Search ..... 169/54, 56, 43, 45, 169/46, 91, DIG. 1, DIG. 2; 417/18, 32, 310; 418/DIG. 1

[56] References Cited

U.S. PATENT DOCUMENTS

| | | | |
|---|---|---|---|
| 1,725,455 | 8/1929 | Hill | 169/56 X |
| 3,191,854 | 6/1965 | Lowler et al. | 418/DIG. 1 X |
| 3,747,404 | 7/1973 | Novak | 418/DIG. 1 X |
| 3,785,755 | 1/1974 | Novak et al. | 418/DIG. 1 X |
| 4,336,001 | 6/1982 | Andrew et al. | 417/310 X |

FOREIGN PATENT DOCUMENTS

| | | | |
|---|---|---|---|
| 3422398 | 12/1985 | Fed. Rep. of Germany | 417/310 |
| 3702652 | 8/1988 | Fed. Rep. of Germany | 418/DIG. 1 |
| 3825085 | 2/1990 | Fed. Rep. of Germany | 169/54 |
| 587944 | 1/1978 | U.S.S.R. | 169/54 |

*Primary Examiner*—Margaret A. Focarino
*Assistant Examiner*—James M. Kannofsky
*Attorney, Agent, or Firm*—Stanley J. Price, Jr.

[57] ABSTRACT

A fire extinguishing apparatus is connected to the safety valve on an oil flooded rotary compressor to receive the contents expelled by the compressor due to internal combustion in the compressor. The contents are conducted to the fire extinguishing apparatus, which disperses them in a tank holding a quantity of non-combustible liquid sufficient to cool them. The fire extinguishing apparatus has a tank for holding non-combustible liquid, a perforated plate to disperse the burning oil and gases throughout the non-combustible liquid, an opening to allow the escape of excess pressure from the tank, and a spring loaded lid to prevent evaporation of the non-combustible liquid. A pipe connects the fire extinguishing apparatus to a safety valve and the pipe has temperature and pressure switches on its surface which shut down the compressor when the temperature and/or pressure in the pipe exceed preset limits.

13 Claims, 2 Drawing Sheets

FIRE EXTINGUISHING APPARATUS FOR COMPRESSORS

BACKGROUND OF THE INVENTION

1. Field of the Invention

This invention relates to an oil flooded rotary compressor, and more particularly, to an oil flooded rotary compressor which includes a fire extinguishing apparatus for controlling internal fires in oil flooded rotary compressors.

2. Description Of The Prior Art

Oil flooded rotary screw and vane compressors are well known in industries utilizing compressors. They are more efficient, quieter, and easier to maintain than piston type compressors. These benefits come with the considerable risk of a large volume of combustible lubricating oil which is used to provide three necessary functions, namely; lubrication, sealing, and cooling.

The lubrication function is applied to bearings, shafts, and gears. The oil is also used to provide sealing between the rotors and the housings in which they run. Lubrication, sealing, and especially compression of the air create a large amount of heat which raises the temperature of the oil. The compressed air and oil are discharged into the oil reservoir which usually also serves as the air receiver.

After being separated from the air, the hot oil is piped to a heat exchanger where the oil is cooled so that it can be reused safely. Thus the oil is used for it's critical third function as a heat exchange fluid.

Rotary compressors are efficient and reliable machines, but they have a bad fire record. It should be recognized that fires occur when a suitable fuel, air, and ignition source are present at the same time. These compressors, working with normal air, have a flow of air and a large amount of combustible lubricant, all heated to a fairly high temperature. All that is needed is an ignition source or a high enough temperature to start a fire.

Attempts have been made to adapt fire suppression apparatus to compressors to control fires. Heretofore, virtually all suppression apparatus use a dry chemical extinguishing agent. These apparatus have failed on actual internal fires as the agent was applied externally while the fires were inside the compressors.

An internal fire within a compressor will cause a severe rise of both temperature and pressure. In tests reported in the literature, where oil flow was purposely stopped or delayed in the compressor, maximum temperatures as high as 600 to 800 degrees C. and pressures up to 15.8 bar g were measured. Since safety (relief) valves generally are set at about 3 bar above the operating pressure, the internal fire is vented generally through the safety valve; but, it may also be vented through other discharge vents or ports which typically may be associated with the control systems of the compressor. In the event of an internal fire, the air within the compressor will expel the products of combustion. Also it will generally expel an excess of oil as the amount of oil in the compressor is considerably greater than the amount of oxygen present to complete combustion of the oil so there may be much unburned oil in the discharge of the safety valve or other vents. Typically the release of the internal fire through the safety valve will spray hot gases and burning oil over a considerable area and at a distance from the compressor. In one very destructive fire, there is evidence that the discharged oil was burning 30 feet from the compressor and combustible material in the vicinity of the compressor had been ignited.

Automatic sprinkler or water spray systems, external to the compressors, have been proposed to protect against the possibility that an internal fire in a compressor could spread to external combustibles, such as a building or stored material. Because the release of gases and oil is intense, the application of the water would have to be quick and the rate should be very high. A particular consideration would be that the sprinkler or water spray system would have to cover a large area as the oil can be sprayed over a considerable distance. Since the discharge pattern of the burning oil from the safety valve is broad and unpredictable, the total water discharge rate might have to be quite large. These fire suppression systems, which must be connected to a water supply, do not lend themselves to portability. The erection of a large automatic sprinkler or water spray system would be a much greater job than setting up a compressor.

Dry chemical systems are not well adapted to controlling large area fires. The dry chemical agent does not cool and its discharge time is generally limited to 15 seconds or less. Since the discharge of gases and burning oil from the safety valve can be much longer, a dry chemical extinguishing system may have exhausted its agent before the discharge of burning oil stops. Water extinguishing systems cool, can cover large areas, and can discharge for long periods of time or until shut off. They are considered to be technically superior but usually are slower to react.

It should be noted that the external fire suppression systems discussed heretofore operate only after a sensing means has detected the presence of flame or an unusual temperature increase on the outside of the compressor. Detection systems require time to respond. Automatic sprinklers, which are regarded as exceptionally reliable, do not respond rapidly. None of these fire suppression systems can prevent the release of flame which, if combustible dust were present, might cause an explosion.

Other apparatus have been proposed that would detect the fire either by sensing internal pressure rise, internal temperature rise, or both. They would respond by releasing, internally within the compressor, a dry chemical agent, a gaseous agent such as halon, or an inerting agent, such as carbon dioxide. The very severe risk of this method is that the release of any agent internally would cause a large and rapid pressure rise in addition to the pressure and temperature rise already caused by the fire. This could overstress the air receiver, or some other component of the compressor, so that it might explode, resulting in a much more serious fire or loss of life.

U.S. Pat. No. 2,470,655 discloses the use of a water soluble oil mixed with water and applied internally to provide cooling and lubrication for compressors.

U.S. Pat. No. 2,523,317 discloses the use of compressed air as a cooling agent in rotor vanes that functions by expansion and cooling.

U.S. Pat. No. 2,701,634 discloses an oil circulating system for rotary compressors.

U.S. Pat. No. 2,983,435 discloses a flow system for lubricating fluid and a control apparatus for oil pumping systems.

U.S. Pat. No. 3,850.554 discloses a rotary compressor utilizing water internally as a cooling and sealing medium.

U.S. Pat. No. 4,025,244 discloses an apparatus for correlating the lubricating liquid volume with the volume of gas drawn into the rotary compressor.

U.S. Pat. No. 4,289,461 discloses a control valve controlled by temperature sensors at the air inlet and after the liquid separator that control the flow of liquid lubricant through a liquid cooler. This patent also discloses temperature sensors located at the air inlet and after the liquid separator to control a valve shunting water around the liquid cooler.

U.S. Pat. No. 4,526,523 discloses an oil pressure control system using a pneumatic control valve to bypass a quantity of the oil pump output in order to relieve the pump of excessive energy demands.

Although the prior art discloses cooling and fire extinguishing apparatus, there is a need for an improved fire control apparatus that is portable, inexpensive, does not increase the risk of explosion, and will prevent the release of flame, burning oil, or gas or oil hot enough to start external combustion.

SUMMARY OF THE INVENTION

In accordance with the present invention, there is provided an oil flooded rotary compressor which includes an air inlet, leading to oil flooded rotors which compress air, which in turn connect by means of a pipe to a receiver for storing the air and separating it from the oil. A pipe guides the separated oil from the receiver through an oil cooler and back to the rotors. Another pipe leads from the receiver to dispense compressed air; a side discharge safety relief valve is attached to the receiver. The side discharge safety valve has a preset pressure limit above which it dispels the contents of the oil flooded rotary compressor to prevent the oil flooded rotary compressor from exploding. The side discharge safety valve is connected by a pipe to the fire extinguishing apparatus to direct the escape of oil and gases into the fire extinguishing apparatus when the internal pressure in the compressor reaches a preset level, in order to avoid an explosion. A pipe connects the air supply in the receiver to an automatic blowdown valve. The automatic blowdown valve releases pressure in the compressor when the compressor is turned off. Another pipe connects the oil from the rotor assembly to the automatic blowdown valve. The automatic blowdown valve is also attached to the fire extinguishing apparatus.

(Note: This Summary and FIG. 1 are based upon the schematic drawing of one manufacturer's compressor and is typical of a number of commercially available compressors. Not all manufacturers use the same arrangement of an automatic blowdown valve. Some manufacturers may use other arrangements to accomplish the same purpose or may have additional vents or openings through which compressed air, oil, or both could flow in the event of a fire or equipment failure. It is essential that any and all vents or openings, made for this or other purposes, be connected to the pipe which connects the safety valve to the fire extinguishing apparatus).

The fire extinguishing apparatus comprises a tank for holding a quantity of non-combustible liquid, such as water, or water containing an antifreeze such as calcium chloride, more than sufficient to cool the entire combustible contents inside the oil flooded rotary compressor below the ignition temperature of the contents. The burning oil and gases are piped into the tank of the fire extinguishing apparatus and discharged adjacent the bottom of the tank. The oil and gases rise through a perforated plate that aids in the dispersion of the hot oil and gases throughout the non-combustible liquid in the tank. The hot gases and oil are thus cooled as they rise to the surface of the non-combustible liquid. Excess pressure inside the tank of the fire extinguishing apparatus caused by the influx of burning oil and gases is released through an opening in the top of the tank. The opening in the tank has a spring loaded cover to prevent excess evaporation of the non-combustible liquid.

The fire extinguishing apparatus is connected to the side discharge safety valve and the automatic blowdown valve and/or all other vents or openings by means of a "T" connector. One pipe leads from the "T" connector to the outlet portion of the side discharge safety valve; another pipe from the "T" connector connects the outlet portion of the automatic blowdown valve to the "T" connector; the third pipe from the "T" connector connects to the pipe opening adjacent the bottom of the tank of the fire extinguishing apparatus to the "T" connector, which is thus connected to both the automatic blowdown valve and the side discharge safety valve. The pipe from the "T" connector to the fire extinguishing apparatus penetrates the wall of the tank of the fire extinguishing apparatus which holds the non-combustible liquid. The pipe leading into the fire extinguishing apparatus has a funnel-shaped exhaust portion. The pipe leading into the fire extinguishing apparatus opens adjacent the bottom surface of the tank through a perforated plate. The tank of the fire extinguishing apparatus has an opening on the upper surface of the tank. The opening has a spring retained cover.

In one embodiment of the invention, a side discharge safety valve on the receiver/separator is connected by a pipe to the fire extinguishing apparatus. The pipe connecting the side discharge safety valve to the fire extinguishing apparatus opens adjacent the bottom surface of the tank of the fire extinguishing apparatus through a perforated plate. The exhaust portion of the pipe in the fire extinguishing apparatus is funnel-shaped. The tank of the fire extinguishing apparatus is filled with an amount of water more than sufficient to cool the entire combustible contents contained in the compressor. The tank of the fire extinguishing apparatus has an opening at the top of the tank which is covered by a spring retained cover. When the side discharge safety valve releases burning oil and gases due to internal combustion or other excess increase in pressure inside the compressor, this flammable mixture is directed into the fire extinguishing apparatus to prevent a fire in the surrounding environment of the compressor. The flaming oil and gases are broken into smaller particles and bubbles by the perforated plate, and are cooled below the ignition temperature by flowing upwardly through the non-combustible liquid. The pressure generated inside the fire extinguishing apparatus by the influx of these gases and oil is released through the cover at the top of the fire extinguishing apparatus. Temperature and pressure switches on the pipe connecting the "T" connector to the fire extinguishing apparatus are activated by the influx of hot oil and gases into the pipe connecting the side discharge safety valve to the fire extinguishing apparatus to turn off the compressor.

In another embodiment of this invention, the fire extinguishing apparatus is connected by a pipe to both the side discharge safety valve and the automatic blowdown valve by means of a "T" connector. If either the side discharge safety valve or the automatic blowdown valve dispel the contents of the compressor due to internal combustion or excess pressure inside the compressor, the contents are directed to the fire extinguishing apparatus. The contents of the rotary compressor pass through the side discharge safety valve or the automatic blowdown valve to the pipe connecting the rotary compressor to the fire extinguishing apparatus. The contents then pass through a funnel-shaped exhaust portion adjacent the bottom of the tank of the fire extinguishing apparatus through a perforated plate. The perforated plate breaks the gases and oil into smaller particles and bubbles which are thus more easily cooled as they rise to the surface of the non-combustible liquid. There are temperature and pressure switches on the pipe connecting the side discharge safety and automatic blowdown valves by way of a "T" connector to the fire extinguishing apparatus which are activated by the influx of oil and gases in the pipe connecting the compressor to the fire extinguishing apparatus, and the switches shut off the oil flooded rotary compressor. Shutting off the compressor restricts the air intake, and the amount of oxygen available to feed an internal fire in the compressor. The cover on the fire extinguishing apparatus raises against the pressure of the spring on the cover to allow the escape of excess pressure in the fire extinguishing apparatus caused by the influx of gases and oil. There is more than sufficient amount of non-combustible liquid in the tank of the fire extinguishing apparatus to cool the entire combustible contents inside the compressor, in order to prevent a fire in the locality of the compressor.

Accordingly, the principal object of the present invention is to provide an improved fire extinguishing apparatus for oil flooded rotary compressors that is portable, inexpensive, does not increase the risk of explosion, and is effective on internal compressor fires.

These and other objects of the present invention will be more completely disclosed and described in the following specifications, the accompanying drawings and the appended claims.

DESCRIPTION OF THE PREFERRED EMBODIMENTS

Figure 1:
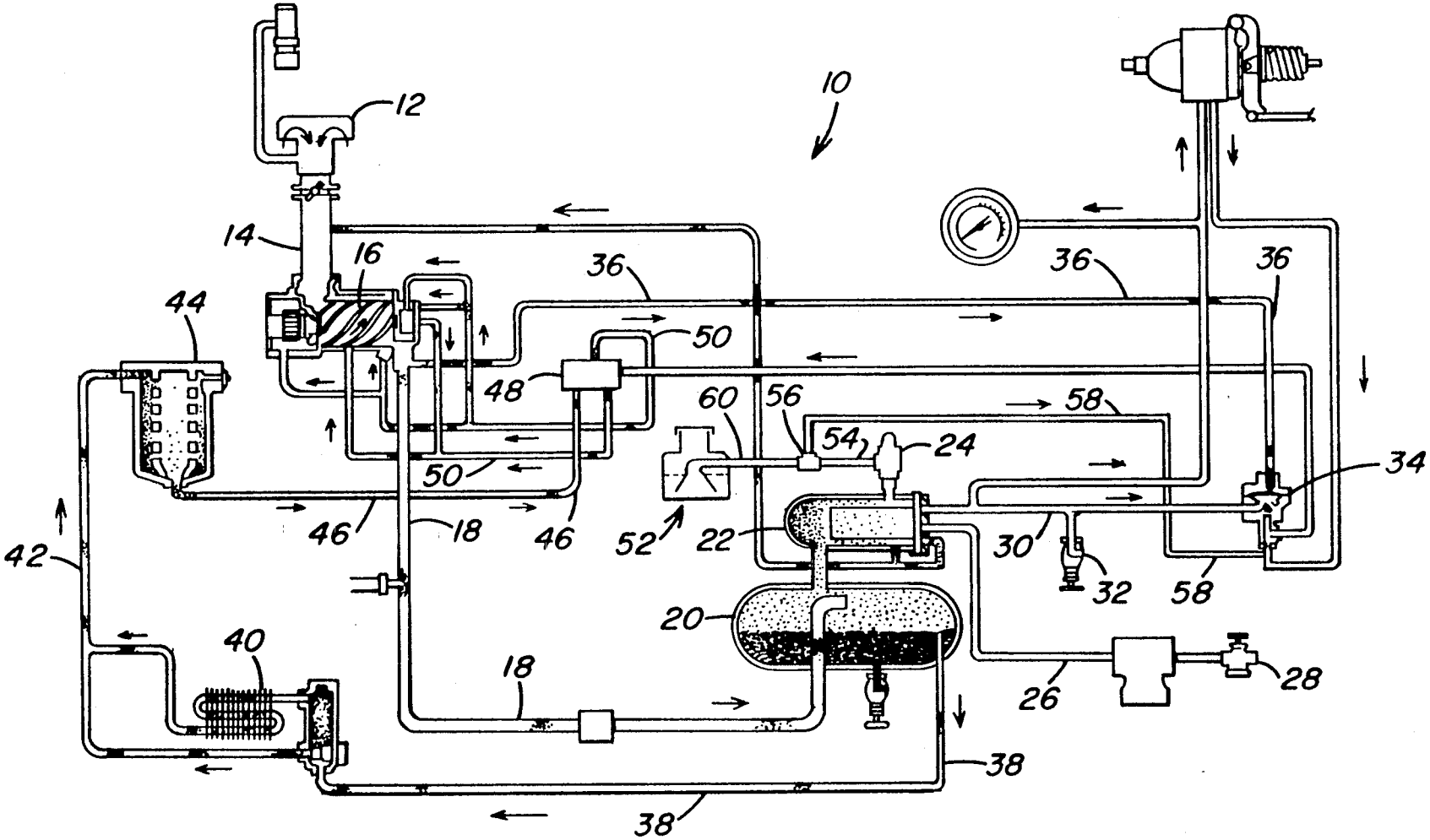
FIG. 1 is a schematic drawing of an oil flooded rotary compressor with the fire extinguishing apparatus.

Referring to the drawings and, particularly to FIG. 1, there is illustrated a schematic diagram of an oil flooded rotary compressor 10 for use in compressing, storing and delivering compressed air. The oil flooded rotary compressor 10 includes an air inlet 12, and a pipe 14 leading from the air inlet 12 to the rotors 16. The rotors 16 compress the air received which is taken by a pipe 18 from the rotors 16 to the first receiving tank 20. The air entrained with oil passes into the second receiving tank 22 which separates the air and oil and the oil falls to the bottom of the first receiving tank 20.

The second receiving tank 22 has on its upper surface a side discharge safety valve 24 to relieve excess pressure inside the compressor 10. The side discharge safety valve 24 is preferably made of steel or cast iron as a brass valve may be melted by the hot gases. Side discharge safety valve 24 is available commercially. The second receiving tank 22 has a pipe 26 to deliver the air to an isolation valve 28. Pipe 30 delivers air to the manual blowdown valve 32 from the second receiving tank 22 to allow the manual relief of internal pressure in the compressor 10. Pipe 30 also delivers air to an automatic blowdown valve 34 that releases pressure when the compressor 10 is turned off.

There is also a pipe 36 which leads from the rotors 16 and carries oil to the automatic blowdown valve 34. Pipe 38 carries oil from the first receiving tank 20 to the oil cooler 40. The oil is then carried by pipe 42 from the oil cooler 40 to the oil filter 44. Pipe 46 carries the oil from oil filter 44 to the oil stop control valve 48, which regulates the flow of oil into the rotors 16. Pipes 50, carry oil from the oil stop control valve 48 back to the rotors 16.

The fire extinguishing apparatus 52 is connected to the oil flooded rotary compressor 10. Pipe 54 from the side discharge safety valve 24 connects to a "T" connector 56. The "T" connector 56 is connected to the automatic blowdown valve 34 by pipe 58, and the "T" connector 56 is also connected to the fire extinguishing apparatus 52 by pipe 60. The fire extinguishing apparatus 52 is shown in greater detail in FIGS. 2 and 3. The pipe 60 leading from the "T" connector 56 to the fire extinguishing apparatus 52 has an exhaust end 62 with a funnel-like shape. Exhaust end 62 of pipe 60 open into a perforated plate 64 near the bottom wall 68 of the tank 90 of fire extinguishing apparatus 52. The fire extinguishing apparatus 52 also has tank side walls 70, tank top walls 88 and a tank neck portion 72. The tank neck portion 72 has an opening 74 covered by a cover 76. The opening 74 in the tank 90 is located above the intended level of the non-combustible liquid 66.

The cover 76 on the opening 74 of the tank neck 72 is held in place by means of a pin 80. The pin 80 passes through the center of the cover 76 and through the center of a pin retainer 78. The pin retainer 78 bridges the span of the opening 74. The pin retainer 78 is rectangular, and does not cover more than one half of the open area of the opening 74. The pin 80 has a pin top 82 and a pin bottom 84. The pin top 82 is a spherical body with a flat bottom surface, and functions to retain a spring 86. The pin bottom 84 is a flattened disc with a circumference wider than the opening in the pin retainer 78 through which the pin 80 passes. The pin bottom 84 retains the pin 80 in the pin retainer 78. The spring 86 is positioned between the pin top 82 and the cover 76. The spring 86 maintains the cover 76 in a closed position when the pressure of the spring 86 is greater than the internal pressure of the fire extinguishing apparatus 52.

Figure 3:
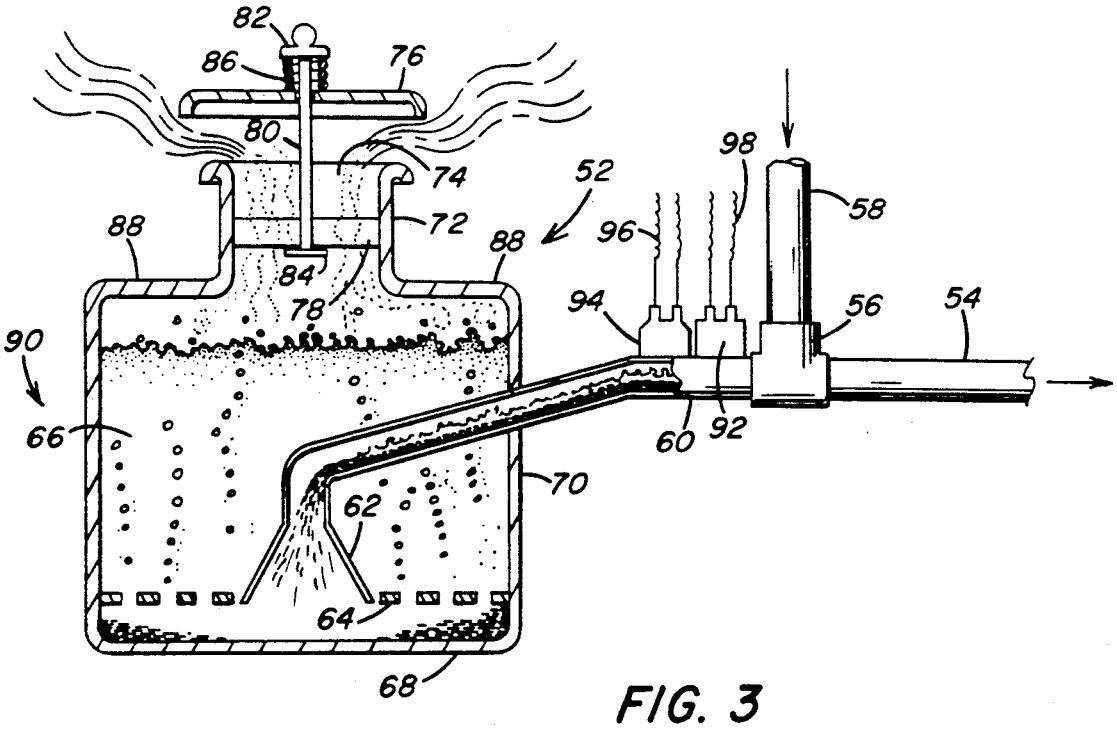
FIG. 3 is another elevational cross section of the preferred embodiment of the fire extinguishing apparatus for an oil flooded rotary compressor which is receiving hot oil and gases from the side discharge safety valve and the automatic blowdown valve of the rotary compressor due to internal combustion in the oil flooded rotary compressor.
Figure 1:
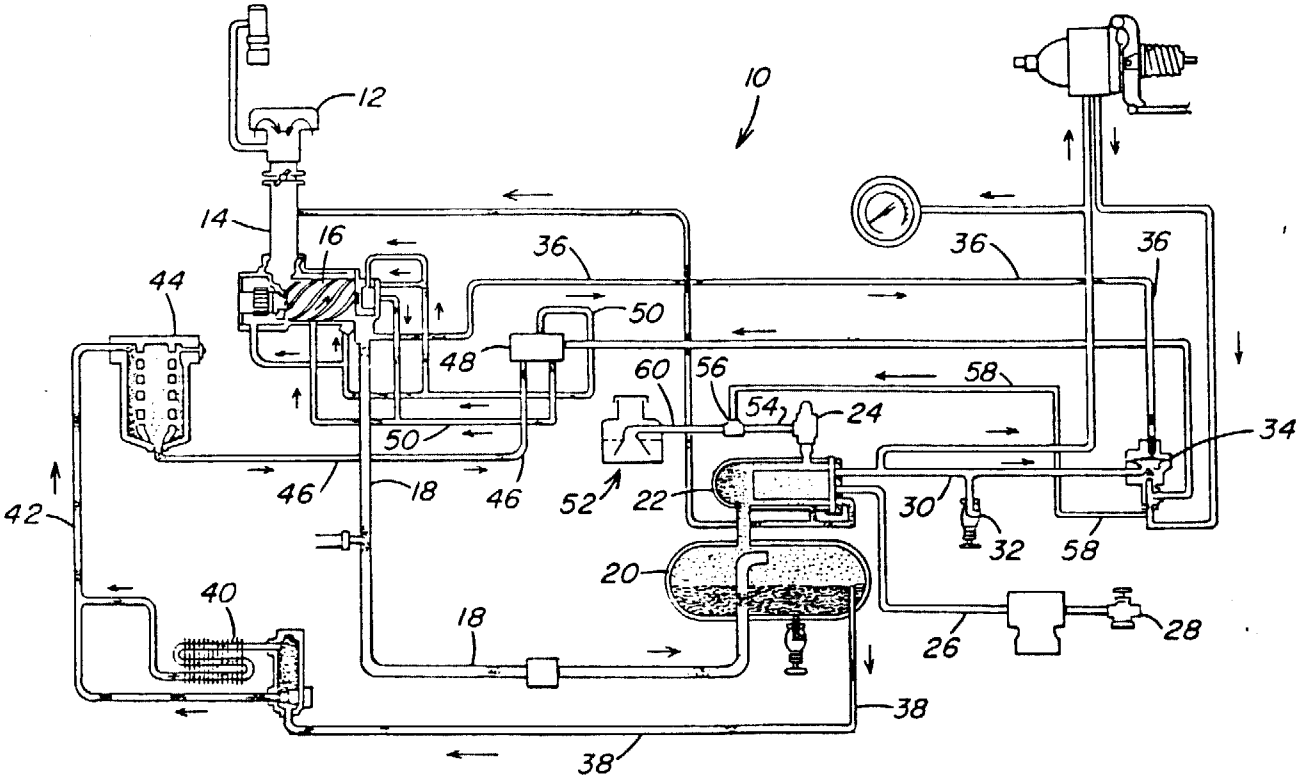
Figure 2:
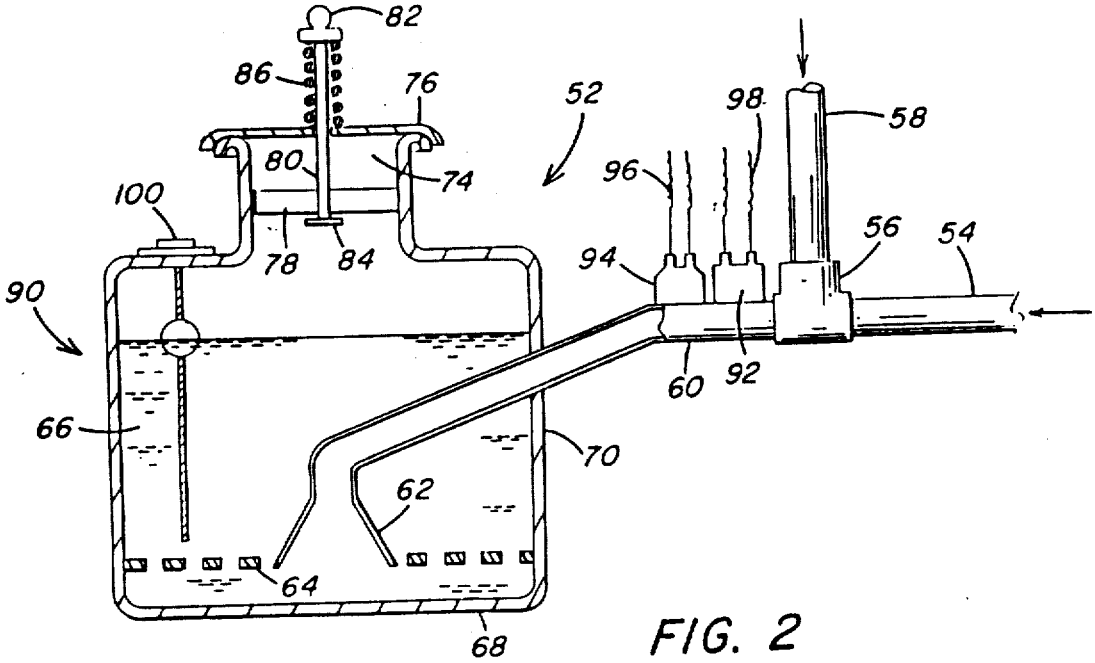
Figure 3:
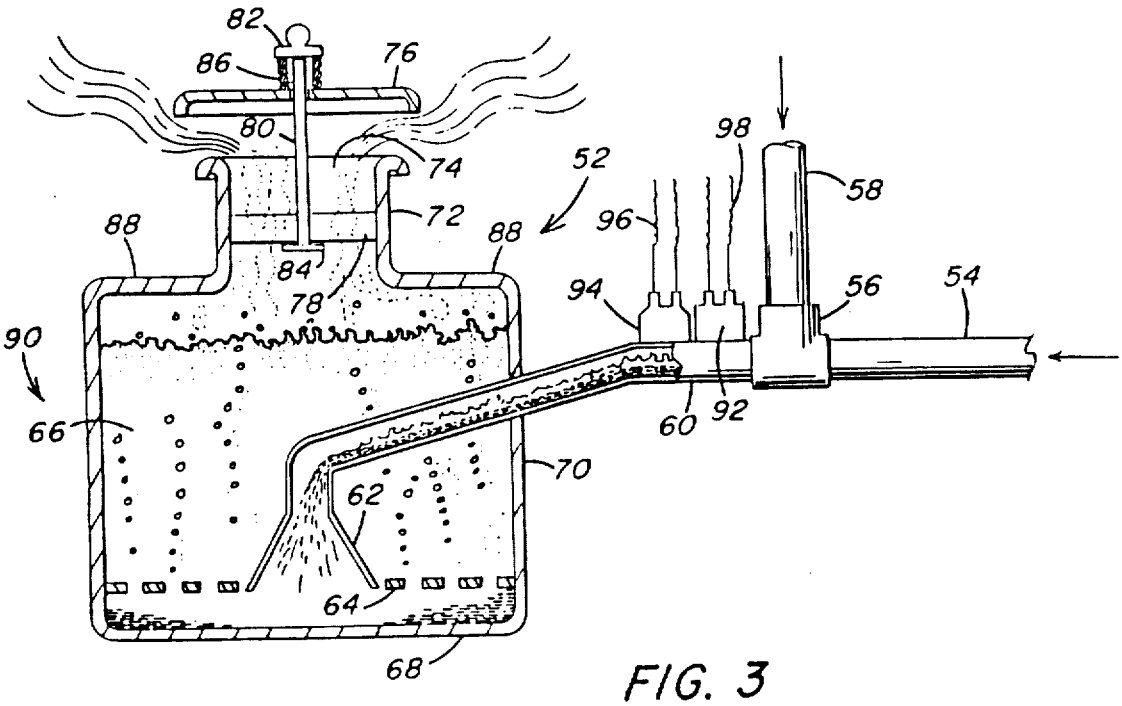

As seen in FIG. 3, when the internal pressure of the fire extinguishing apparatus 52 exceeds the pressure exerted by the spring 86 due to the influx of burning oil and gases from the oil flooded rotary compressor 10, the cover 76 of the fire extinguishing apparatus 52 is lifted against the force of the spring 86.

Figure 2:
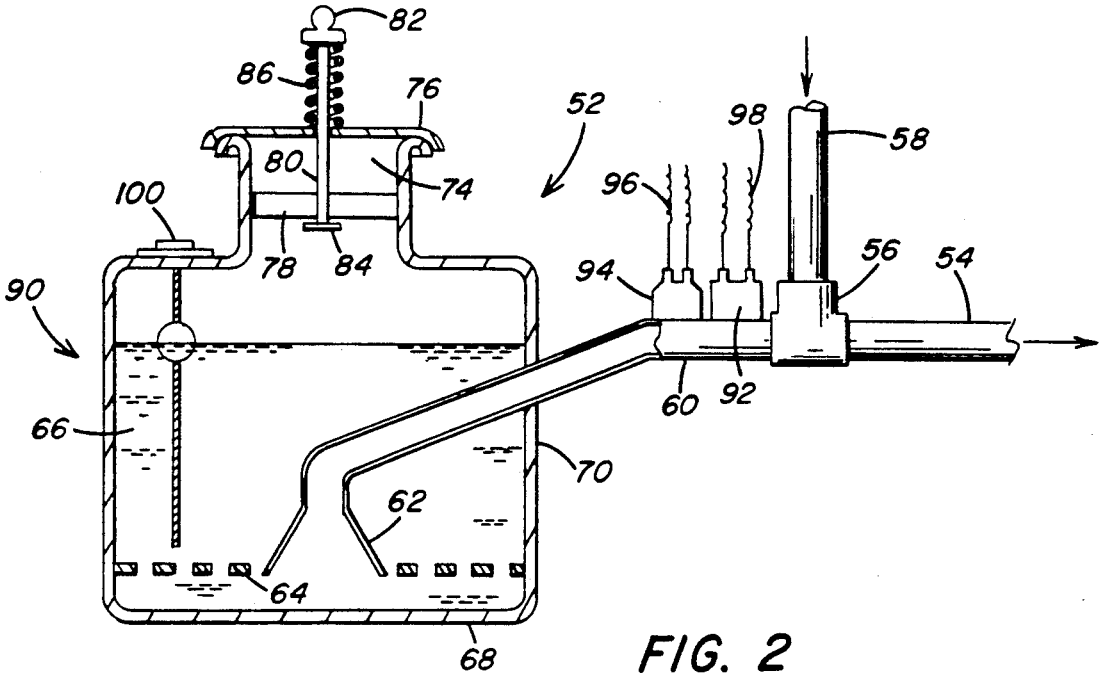
FIG. 2 is an elevational cross section of the preferred embodiment of the fire extinguishing apparatus for an oil flooded rotary compressor.

The pipe 60 leading from the "T" connector 56 to the fire extinguishing apparatus 52 has a temperature switch 92 and a pressure switch 94 as illustrated in FIGS. 2 and 3. The temperature switch 92 responds to the increase in temperature in pipe 60 due to the influx of oil and gases from the internal combustion in the oil flooded rotary compressor 10 by shutting off the oil flooded rotary compressor 10 by a signal sent through the temperature switch wiring 98.

The pressure switch 94 responds to an increase in pressure in pipe 60 due to the influx of oil and gases into pipe 60 from the oil flooded rotary compressor 10 by shutting off the oil flooded rotary compressor 10 by a signal sent through the pressure switch wiring 96. Temperature switch 92 and pressure switch 94 are available commercially.

A float type liquid level indicator 100 is mounted on the tank top wall 88 to indicate the non-combustible liquid 66 level to facilitate proper maintenance of the fire extinguishing apparatus 52, as shown in FIG. 2. In lieu of the level indicator, it is possible to use a level switch generally designated at 102 in FIG. 3 that would prevent operation of the compressor if the level of the non-combustible liquid were too low to cool the combustible contents in the oil flooded rotary compressor.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An apparatus for extinguishing an oil-flooded rotary compressor fire comprising, a tank for holding a non-combustible liquid, said tank having an upper portion and a lower portion, a valve on an oil flooded rotary compressor having a preset limit at which said valve will dispel the oil and gases contained in said compressor from an outlet portion of said valve, said outlet portion of said valve being connected to a pipe, a portion of said pipe having an opening which opens into said tank adjacent said lower portion of said tank, said pipe having means to receive said oil and gases from said compressor through said outlet portion of said valve when said valve dispels said oil and gases due to an increase in pressure in said compressor beyond said preset pressure limits, said tank having means to receive said oil and gases from said pipe and to percolate said oil and gases through said non-combustible liquid in said tank to extinguish and cool said oil and gases from said oil flooded rotary compressor through said pipe, said upper portion of said tank having an opening to release excess pressure in said tank.

2. The fire extinguishing apparatus as in claim 1, wherein said pipe opening discharges through a perforated plate.

3. The fire extinguishing apparatus as in claim 1, wherein said pipe is funnel-shaped at the portion of said pipe which opens into said tank.

4. The fire extinguishing apparatus as in claim 1, wherein said pipe has a means for detecting an increase in temperature in said pipe and shutting down said compressor when said temperature in said pipe exceeds a preset temperature level.

5. The fire extinguishing apparatus as in claim 1, wherein said pipe has a means for detecting an increase in pressure in said pipe and shutting down said compressor when said pressure in said pipe exceeds a preset pressure level.

6. The fire extinguishing apparatus as in claim 1, wherein said tank has a means for indicating said non-combustible liquid level.

7. The fire extinguishing apparatus as in claim 1, wherein said tank has a means for detecting a low level of said non-combustible liquid and shutting down said compressor when said liquid level reaches a preset lower limit.

8. The fire extinguishing apparatus as in claim 1, wherein said compressor has vents and openings including an air inlet and an isolation valve, and said pipe has means for connecting said fire extinguishing apparatus to all the vents and openings in said compressor other than the air inlet and the isolation valve.

9. The fire extinguishing apparatus as in claim 1, wherein said tank has a cover on said opening.

10. The fire extinguishing apparatus as in claim 9, wherein said cover is spring loaded.

11. A method of preventing fires in the vicinity of an oil flooded rotary compressor which comprises connecting a valve on said oil flooded rotary compressor to a first end of a pipe, said valve has means to dispel the oil and gases in said compressor when the pressure inside said compressor exceeds a preset pressure limit, connecting a second end of said pipe to a tank holding a non-combustible liquid, said tank has means to receive said oil and gases in said compressor from said pipe connected to said valve, and to percolate said oil and gases through said non-combustible liquid to extinguish and cool said oil and gases in said tank received from said oil flooded rotary compressor through said pipe.

12. The method of preventing fires in the vicinity of an oil rotary compressor as in claim 11 which further comprises attaching to said pipe a means for detecting an increase in temperature in said pipe above a preset level and shutting down said compressor when said temperature in said pipe exceeds said preset temperature level.

13. The method of preventing fires in the vicinity of an oil flooded rotary compressor as in claim 11 which further comprises attaching to said pipe a means for detecting an increase in pressure in said pipe above a preset level and shutting down said compressor when said pressure in said pipe exceeds said preset pressure level.

* * * * *

UNITED STATES PATENT AND TRADEMARK OFFICE

CERTIFICATE OF CORRECTION

PATENT NO. : 5,099,976

DATED : March 31, 1992

INVENTOR(S) : Will B. Jamison

It is certified that error appears in the above-indentified patent and that said Letters Patent is hereby corrected as shown below:

The Title page showing the illustrative figure should be deleted and replaced with the attached Title page.

Sheets 1 and 2 of the drawings, consisting of Figs, 1-3, should be deleted to be replaced with the sheets of drawings as shown on the attached pages.

Signed and Sealed this

Twenty-eighth Day of September, 1993

Bruce Lehman

*Attest:*

BRUCE LEHMAN

*Attesting Officer*

*Commissioner of Patents and Trademarks*

United States Patent [19]

Jamison

[11] Patent Number: 5,099,976

[45] Date of Patent: Mar. 31, 1992

[54] FIRE EXTINGUISHING APPARATUS FOR COMPRESSORS

[75] Inventor: Will B. Jamison, McMurray, Pa.

[73] Assignee: W. B. Jamison Limited Partnership, McMurray, Pa.

[21] Appl. No.: 600,571

[22] Filed: Oct. 19, 1990

[51] Int. Cl.[5] ..... A62C 3/00; A62C 3/06

[52] U.S. Cl. ..... 169/54; 169/45; 169/46; 169/56; 169/DIG. 1; 417/32; 417/310; 418/DIG. 1

[58] Field of Search ..... 169/54, 56, 43, 45, 169/46, 91, DIG. 1, DIG. 2; 417/18, 32, 310; 418/DIG. 1

[56] References Cited

U.S. PATENT DOCUMENTS

| | | | |
|---|---|---|---|
| 1,725,455 | 8/1929 | Hill | 169/56 X |
| 3,191,854 | 6/1965 | Lowler et al. | 418/DIG. 1 X |
| 3,747,404 | 7/1973 | Novak | 418/DIG. 1 X |
| 3,785,755 | 1/1974 | Novak et al. | 418/DIG. 1 X |
| 4,336,001 | 6/1982 | Andrew et al. | 417/310 X |

FOREIGN PATENT DOCUMENTS

| | | | |
|---|---|---|---|
| 3422398 | 12/1985 | Fed. Rep. of Germany | 417/310 |
| 3702652 | 8/1988 | Fed. Rep. of Germany | 418/DIG. 1 |
| 3825085 | 2/1990 | Fed. Rep. of Germany | 169/54 |
| 587944 | 1/1978 | U.S.S.R. | 169/54 |

*Primary Examiner*—Margaret A. Focarino
*Assistant Examiner*—James M. Kannofsky
*Attorney, Agent, or Firm*—Stanley J. Price, Jr.

[57] ABSTRACT

A fire extinguishing apparatus is connected to the safety valve on an oil flooded rotary compressor to receive the contents expelled by the compressor due to internal combustion in the compressor. The contents are conducted to the fire extinguishing apparatus, which disperses them in a tank holding a quantity of non-combustible liquid sufficient to cool them. The fire extinguishing apparatus has a tank for holding non-combustible liquid, a perforated plate to disperse the burning oil and gases throughout the non-combustible liquid, an opening to allow the escape of excess pressure from the tank, and a spring loaded lid to prevent evaporation of the non-combustible liquid. A pipe connects the fire extinguishing apparatus to a safety valve and the pipe has temperature and pressure switches on its surface which shut down the compressor when the temperature and/or pressure in the pipe exceed preset limits.

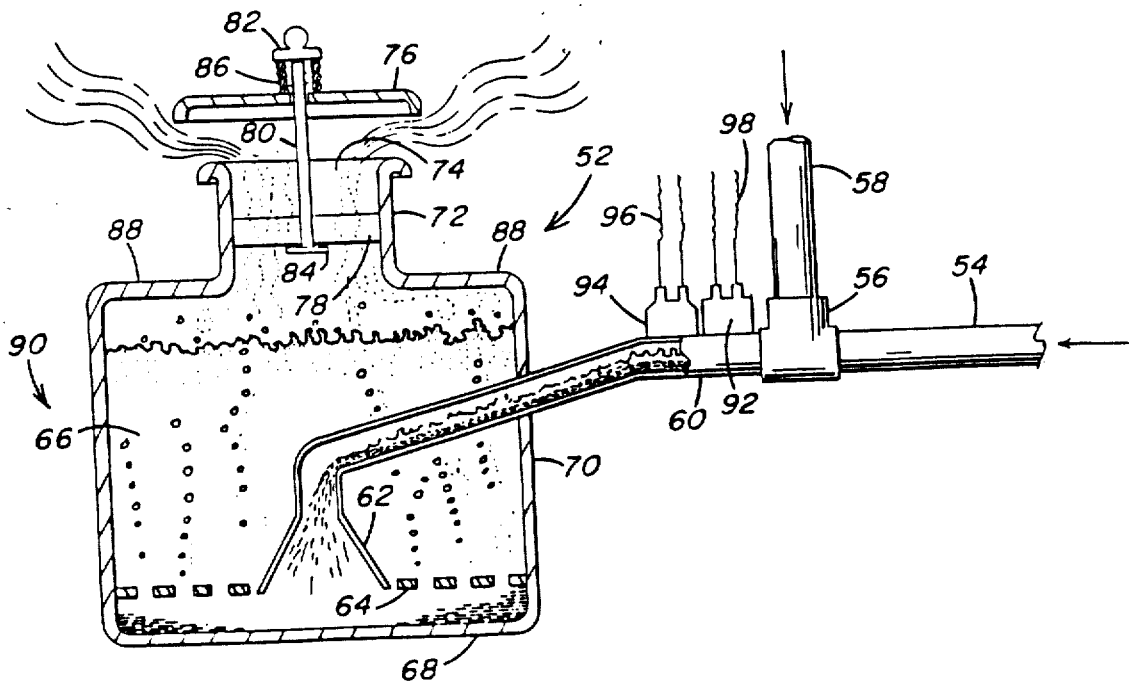

13 Claims, 2 Drawing Sheets